US005875794A

United States Patent [19]

Ekman

[11] Patent Number: 5,875,794

[45] Date of Patent: Mar. 2, 1999

[54] HAIR CARE PRODUCT ORGANIZING AND STORAGE SYSTEM

[76] Inventor: Mavis V. Ekman, 5822 Brookwood Drive, Nanaimo, BC, Canada, V9T 6J5

[21] Appl. No.: 74,161

[22] Filed: May 7, 1998

[51] Int. Cl.[6] ..... A45D 33/20

[52] U.S. Cl. ..... 132/287; 206/373; 206/581; 132/315

[58] Field of Search ..... 132/287, 288, 132/286, 312, 314, 315, 316, 269, 271, 233, 229; 206/320, 373, 576, 581, 745, 747, 748, 749; 294/146; 190/1, 4, 109, 110, 112, 18 R; 219/221, 226, 386, 242

[56] References Cited

U.S. PATENT DOCUMENTS

| | | | |
|---|---|---|---|
| 717,433 | 12/1902 | Morris | 206/748 |
| 859,817 | 7/1907 | Kersey | 206/749 |
| 1,206,276 | 11/1916 | Wallach | 206/581 |
| 1,651,898 | 12/1927 | Maillard | 132/288 |
| 1,652,771 | 12/1927 | Deubel | 206/581 |
| 1,752,948 | 4/1930 | Herrmann | 132/287 |
| 1,973,283 | 9/1934 | Buttrick | 206/581 |
| 2,331,428 | 10/1943 | Selezneff | 206/581 |
| 5,117,090 | 5/1992 | Askins | 132/229 |

FOREIGN PATENT DOCUMENTS

| | | | |
|---|---|---|---|
| 2420316 | 10/1979 | France | 132/286 |
| 2606614 | 5/1988 | France | 132/288 |
| 7499 | of 1885 | United Kingdom | 190/110 |

*Primary Examiner*—Todd E. Manahan
*Assistant Examiner*—Eduardo C. Robert

[57] ABSTRACT

A hair care product carrying case is provided including a housing having a base and a pair of side portions each hingably coupled to opposite sides of the base. Also included is a plurality of hair care accessories releasably mounted within the housing.

9 Claims, 6 Drawing Sheets

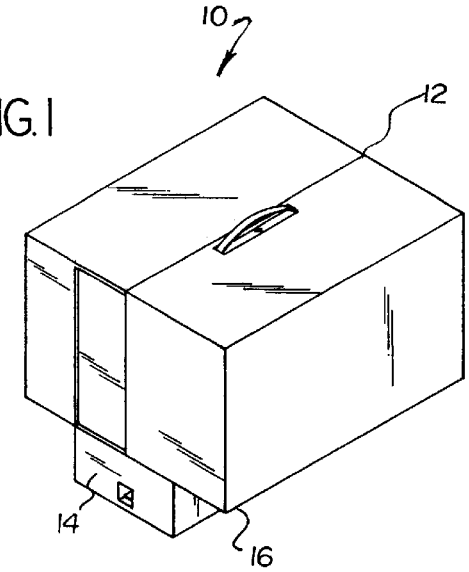
FIG. 1
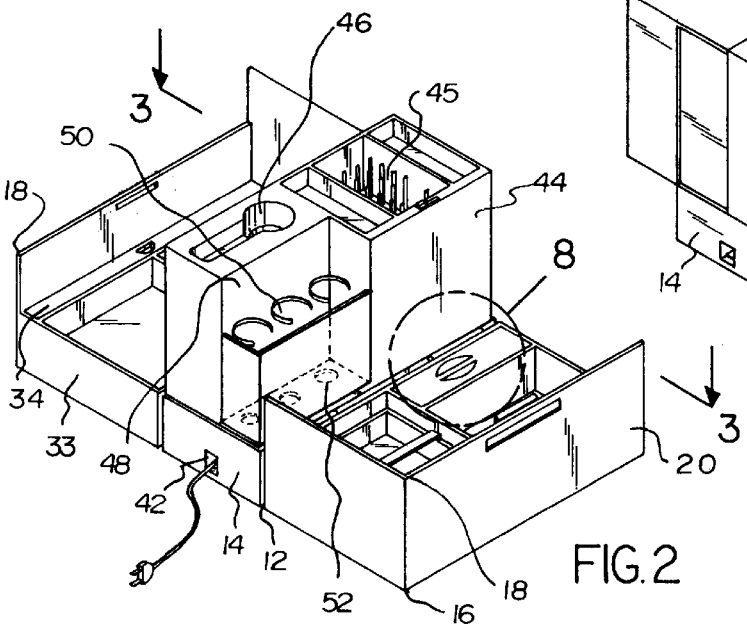
FIG. 2
FIG. 3
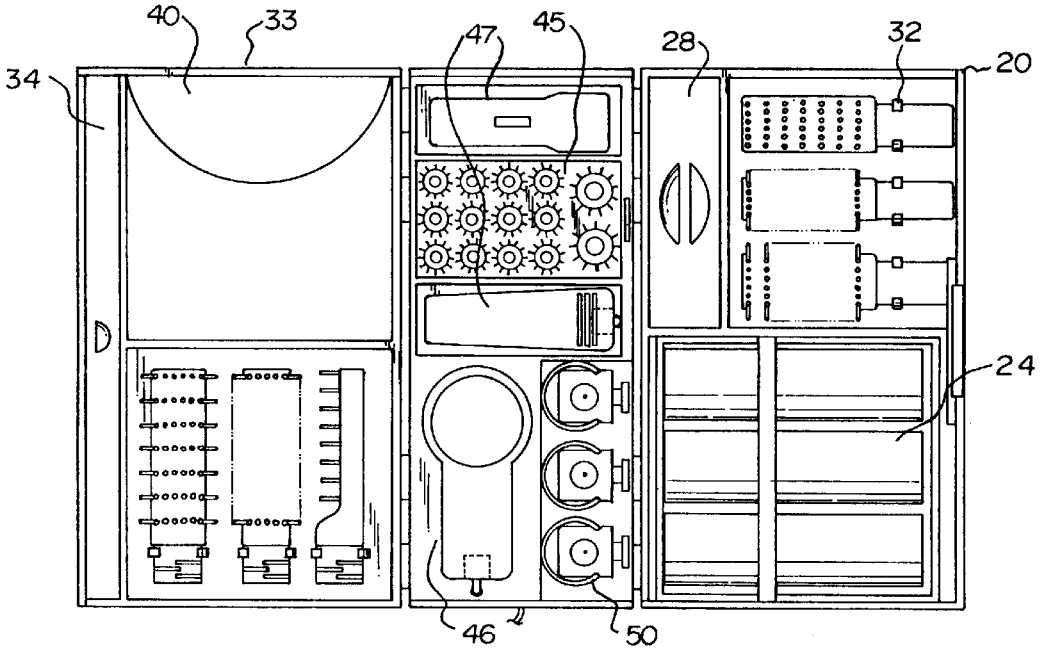

HAIR CARE PRODUCT ORGANIZING AND STORAGE SYSTEM

BACKGROUND OF THE INVENTION

1. Field of the Invention

The present invention relates to hair care product organizers and more particularly pertains to a new hair care product organizing and storage system for storing and organizing a plurality of hair care accessories.

2. Description of the Prior Art

The use of hair care product organizers is known in the prior art. More specifically, hair care product organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair care product organizers include U.S. Pat. No. 5,124,532; U.S. Pat. No. 5,547,393; U.S. Pat. No. 5,014,371; U.S. Pat. No. 5,220,931; U.S. Pat. No. 3,455,309; and U.S. Pat. No. 2,038,319.

In these respects, the hair care product organizing and storage system according to the present invention substantially departs from the conventional concepts and designs of the prior art, and in so doing provides an apparatus primarily developed for the purpose of storing and organizing a plurality of hair care accessories.

SUMMARY OF THE INVENTION

In view of the foregoing disadvantages inherent in the known types of hair care product organizers now present in the prior art, the present invention provides a new hair care product organizing and storage system construction wherein the same can be utilized for storing and organizing a plurality of hair care accessories.

The general purpose of the present invention, which will be described subsequently in greater detail, is to provide a new hair care product organizing and storage system apparatus and method which has many of the advantages of the hair care product organizers mentioned heretofore and many novel features that result in a new hair care product organizing and storage system which is not anticipated, rendered obvious, suggested, or even implied by any of the prior art hair care product organizers, either alone or in any combination thereof.

To attain this, the present invention generally comprises a housing having a base with a rectangular configuration. The base comprises a bottom face, a top face and a periphery formed therebetween defined by a pair of elongated side faces and a pair of short end faces. The housing further includes a pair of side portions each including a rectangular face and a rectangular side wall integrally coupled to a periphery of the rectangular face and extending outwardly therefrom. As such, each side portion defines an interior space with an open face having a peripheral edge. Such peripheral edge is defined by a pair of elongated side edges and a pair of short ends edges. The elongated side edges of the peripheral edge of the side portions are hingably coupled to opposite sides of the top face. As best shown in FIG. 2, the side wall of at least one side portion further includes a planar lip extending upwardly from one of the side edges and one of the end edges thereof in coplanar relationship therewith. A first one of the side portions of the housing has a compartment with a mounting plate having a laterally extending retaining strap. As shown in FIG. 6, such mounting plate further has a pair of elongated slots formed in side faces thereof adjacent to one of the end faces thereof. Also included is a pair of support arms each having a first end pivotally coupled to the first side portion and a second end slidably and rotatably mounted within an associated one of the elongated slots. By this structure, the mounting plate may be selectively angled upwardly. The first one of the side portions further includes a large drawer having a first face with a handle for sliding the drawer away from the first side portion. An open face of the drawer is provided for gaining access to the drawer when slid away from the first side portion. As shown in FIG. 8, a removable tray is situated within an interior space of the drawer with multiple compartments formed therein. The first side portion further includes a plurality resilient C-shaped clamps, as shown in FIG. 3. A second one of the side portions is equipped with a small drawer having a first face with a handle for sliding the drawer away from the second side portion. Similar to the drawer of the first side portion, an open face is provided for gaining access to the drawer when slid away from the second side portion. A removable tray is situated within the drawer of the second side portion. As shown in FIG. 7, such removable tray is equipped with multiple packets. It should be noted that the second side portion further includes a large pouch and a plurality resilient C-shaped clamps. Also included is a power cord dispensing assembly situated within the base. The power cord includes a cord having a first end with a plug which is dispensable from a cut out formed in one of the short end faces of the base. FIGS. 2–4 show an accessory mount having a rectangular configuration and being integrally coupled to the top face of the base of the housing. The accessory mount includes a top face with a first recess having a plurality of heated dowels situated therein and connected to the power cord. As such, the heated dowels are adapted for receiving and heating curlers releasably situated thereon. The top face of the accessory mount is further equipped with a second recess with a circular portion and an elongated portion for accepting a hair dyer. Lastly, the top face has a third and fourth recess flanking the first recess for accepting various clippers. The accessory mount further includes a rectangular cut out formed along a height thereof for defining a bottom wall and a pair of perpendicular walls. One of such perpendicular walls has a plurality of resilient C-shaped scissors and curling iron clamps. Further, the bottom wall has a plurality of circular recesses each formed therein below an associated one of the clamps. During use, the side portions are adapted to be pivoted together such that the lips thereof encompass the accessory mount. For selectively preventing unauthorized access to the accessory mount and the interior spaces of the side portions of the housing, a locking assembly is preferably included. Finally, a timer is positioned on the housing for indicating a cessation of a selected time period.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new hair care product organizing and storage system apparatus and method which has many of the advantages of the hair care product organizers mentioned heretofore and many novel features that result in a new hair care product organizing and storage system which is not anticipated, rendered obvious, suggested, or even implied by any of the prior art hair care product organizers, either alone or in any combination thereof.

It is another object of the present invention to provide a new hair care product organizing and storage system which may be easily and efficiently manufactured and marketed.

It is a further object of the present invention to provide a new hair care product organizing and storage system which is of a durable and reliable construction.

An even further object of the present invention is to provide a new hair care product organizing and storage system which is susceptible of a low cost of manufacture with regard to both materials and labor, and which accordingly is then susceptible of low prices of sale to the consuming public, thereby making such hair care product organizing and storage system economically available to the buying public.

Still yet another object of the present invention is to provide a new hair care product organizing and storage system which provides in the apparatuses and methods of the prior art some of the advantages thereof, while simultaneously overcoming some of the disadvantages normally associated therewith.

Still another object of the present invention is to provide a new hair care product organizing and storage system for storing and organizing a plurality of hair care accessories.

Even still another object of the present invention is to provide a new hair care product organizing and storage system that includes a housing having a base and a pair of side portions each hingably coupled to opposite sides of the base. Also included is a plurality of hair care accessories releasably mounted within the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new hair care product organizing and storage system according to the present invention.

FIG. 2 is a perspective view of the present invention in an open orientation.

FIG. 3 is a top view of the present invention.

DESCRIPTION OF THE PREFERRED EMBODIMENT

Figure 4:
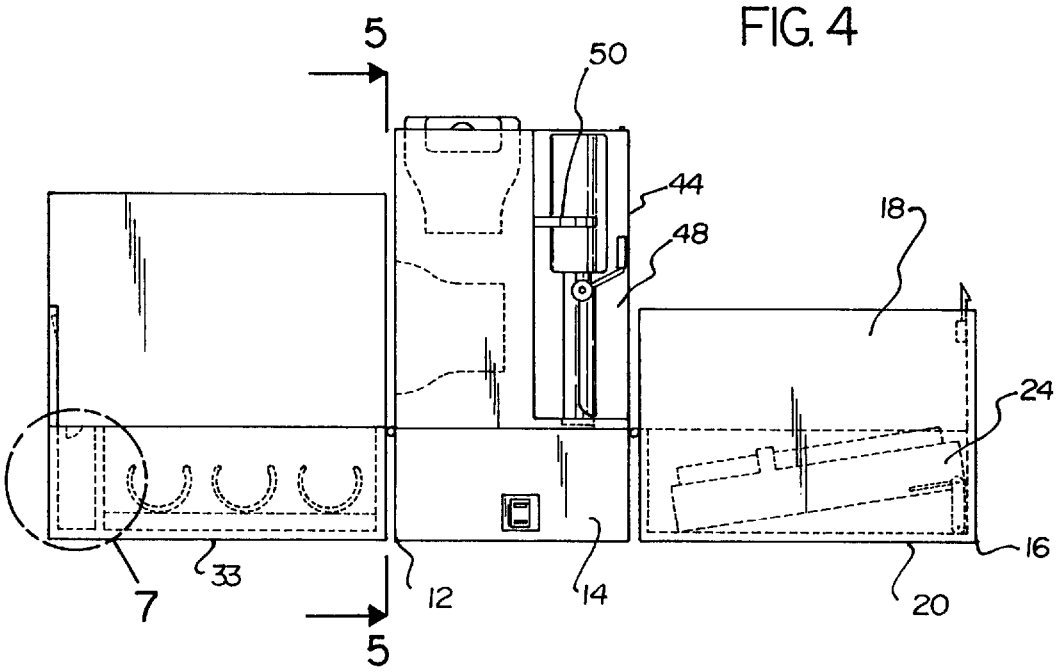
FIG. 4 is a side view of the present invention.
Figure 5:
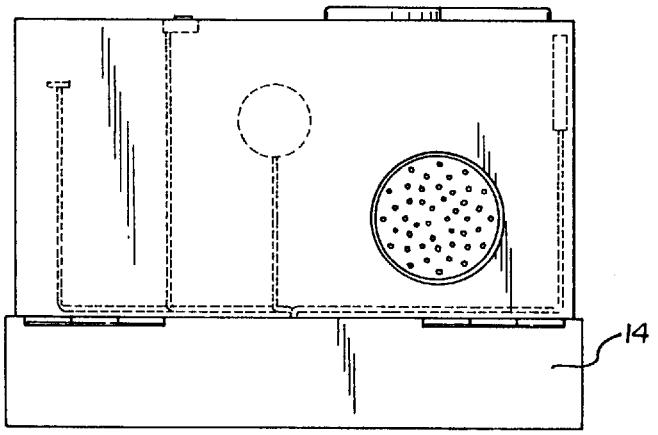
FIG. 5 is a side view of the present invention in a closed orientation.

With reference now to the drawings, and in particular to FIGS. 1 through 14 thereof, a new hair care product organizing and storage system embodying the principles and concepts of the present invention and generally designated by the reference numeral 10 will be described.

The present invention, designated as numeral 10, includes a housing 12 having a base 14 with a rectangular configuration. The base comprises a bottom face, a top face and a periphery formed therebetween defined by a pair of elongated side faces and a pair of short end faces.

The housing further includes a pair of side portions 16 each including a rectangular face and a rectangular side wall integrally coupled to a periphery of the rectangular face and extending outwardly therefrom. As such, each side portion defines an interior space with an open face having a peripheral edge. Such peripheral edge is defined by a pair of elongated side edges and a pair of short ends edges. The elongated side edges of the peripheral edge of the side portions are hingably coupled to opposite sides of the top face. As best shown in FIG. 2, the side wall of at least one side portion further includes an L-shaped planar lip 18 extending upwardly from one of the side edges and one of the end edges of the side wall in coplanar relationship therewith.

Figure 6:
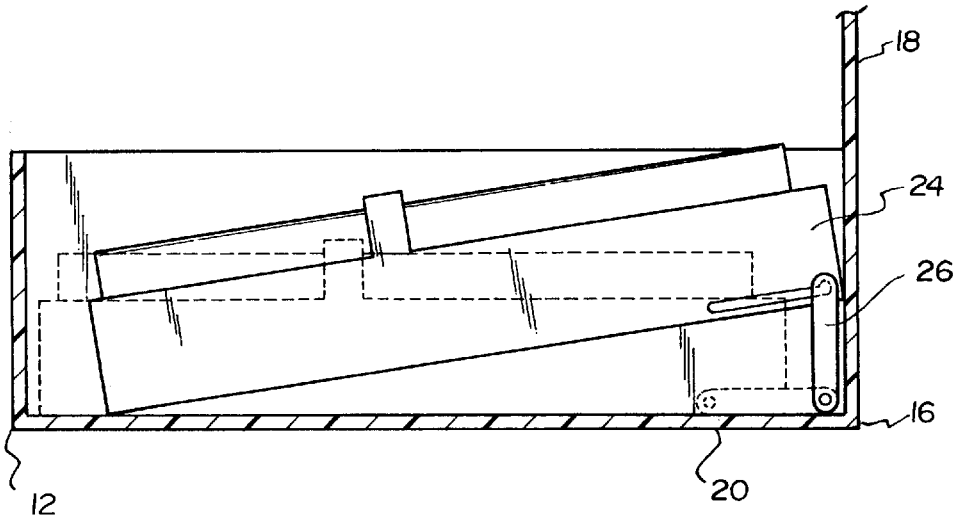
FIG. 6 is a side view of the mounting plate of the first side portion of the present invention.

A first one of the side portions 20 of the housing has a compartment 22 with a mounting plate 24 having a laterally extending retaining strap. As shown in FIG. 6, such mounting plate further has a pair of elongated slots formed in its side faces adjacent to one of the end faces thereof. Also included is a pair of support arms 26 each having a first end pivotally coupled to the first side portion and a second end slidably and rotatably mounted within an associated one of the elongated slots. By this structure, the mounting plate may be selectively angled upwardly.

Figure 8:
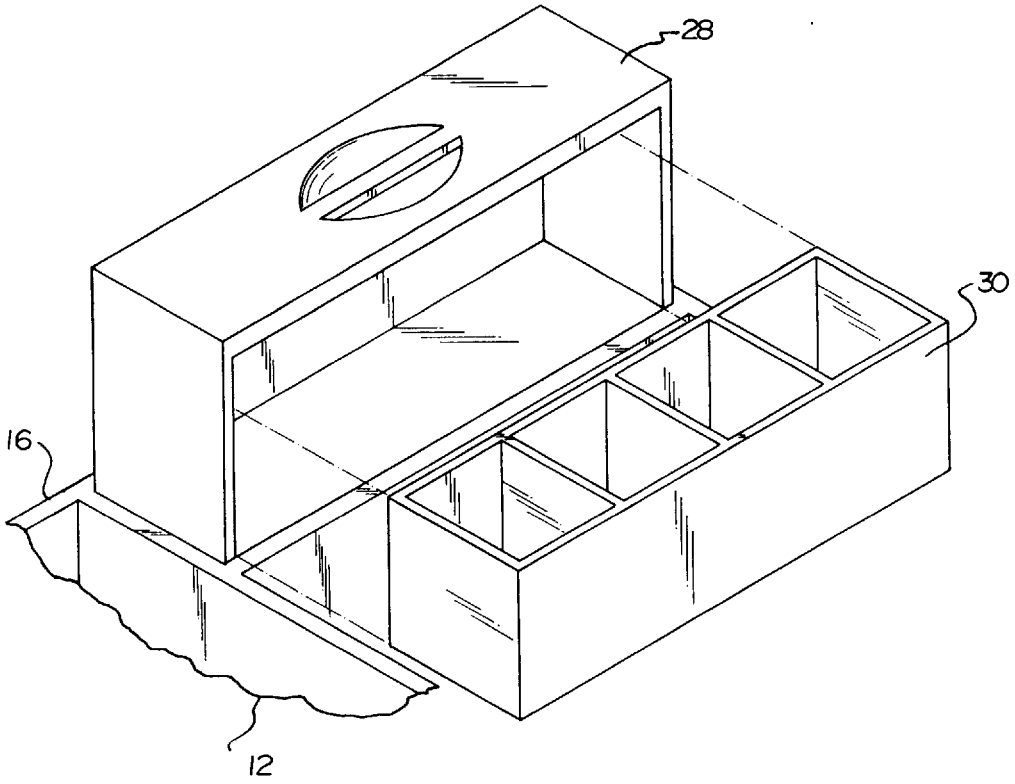
FIG. 8 is a perspective view of the drawer of the first side portion of the present invention.

The first one of the side portions further includes a large drawer 28 having a first face with a handle for sliding the drawer away from the first side portion. An open face of the drawer is provided for gaining access to the drawer when slid away from the first side portion. As shown in FIG. 8, a removable tray 30 is situated within an interior space of the drawer with multiple compartments formed therein. The first side portion further includes a plurality resilient C-shaped clamps 32, as shown in FIG. 3.

Figure 7:
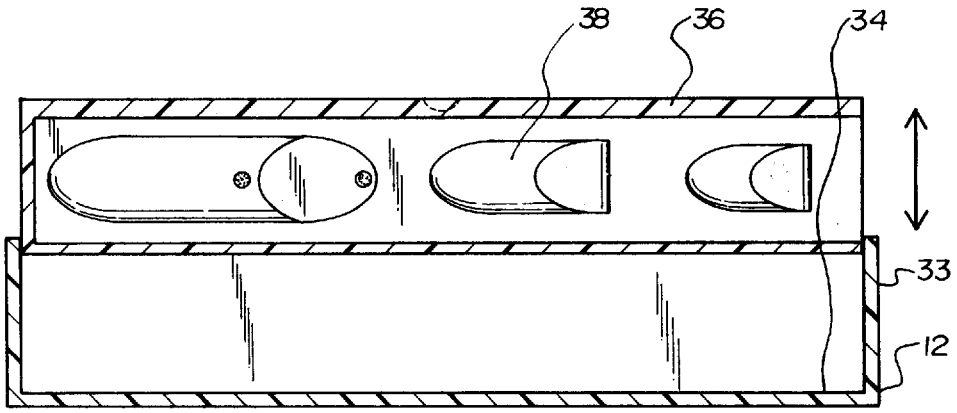
FIG. 7 is a side view of the drawer of the second side portion of the present invention.
Figure 9:
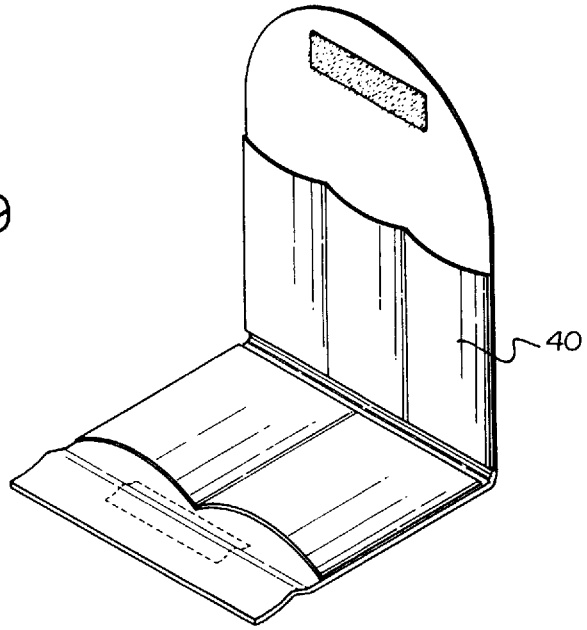
FIG. 9 is a perspective of the pouch of the second side portion of the present invention.
Figure 10:
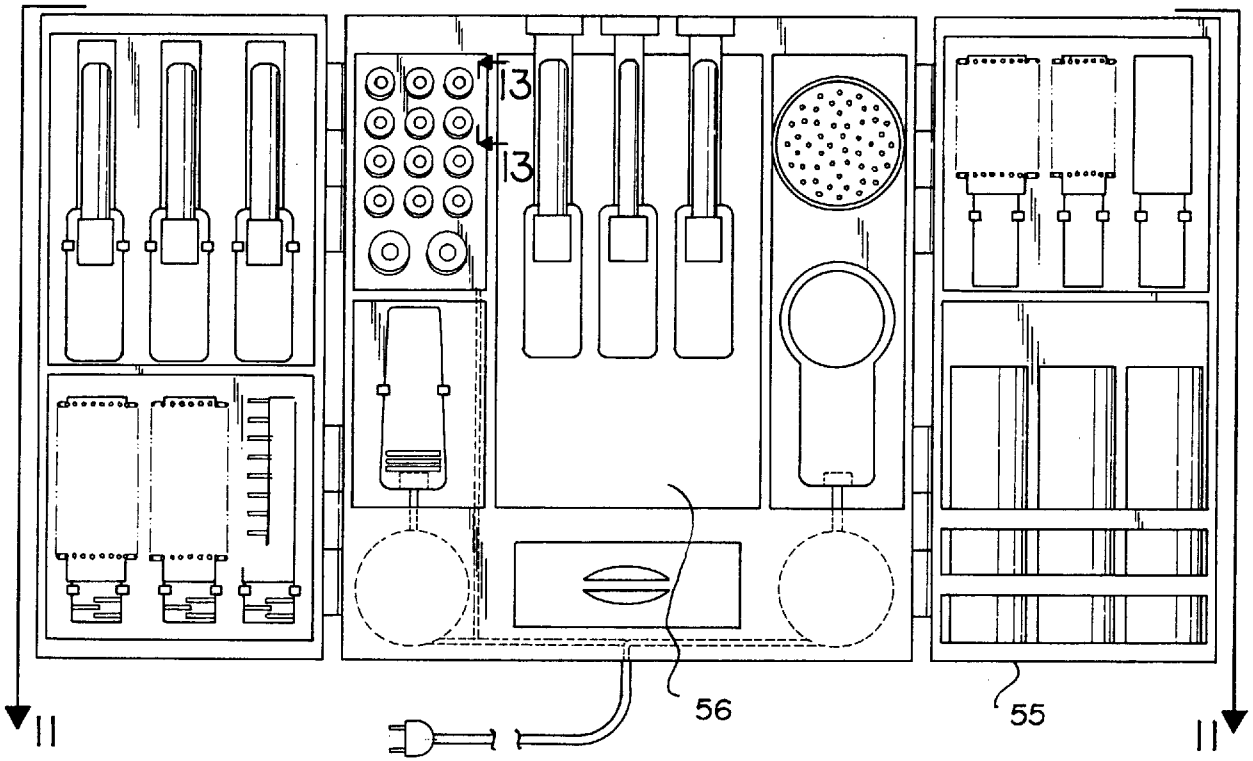
FIG. 10 is a top view of an alternate embodiment of the present invention.
Figure 11:
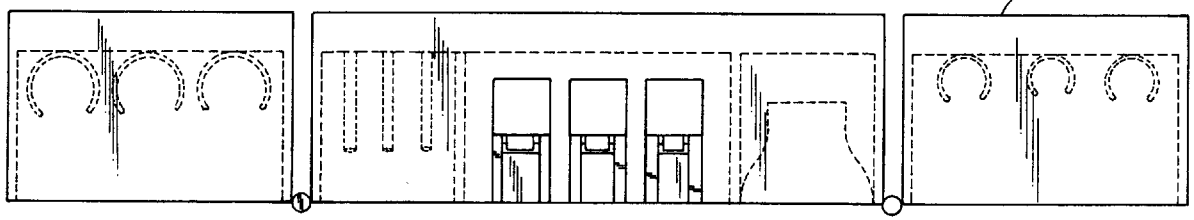
FIG. 11 is a side view of the alternate embodiment of the present invention.
Figure 12:
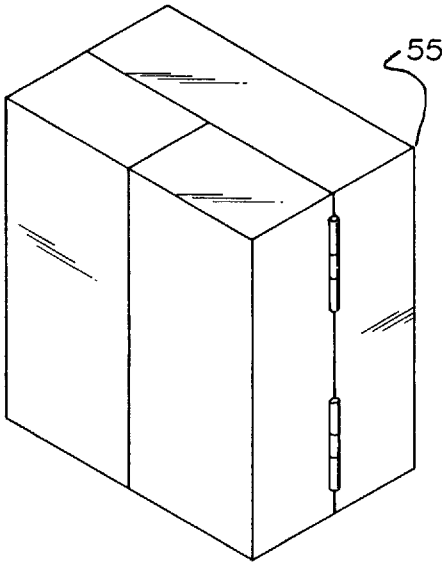
FIG. 12 is a perspective of the alternate embodiment of the present invention.
Figure 13:
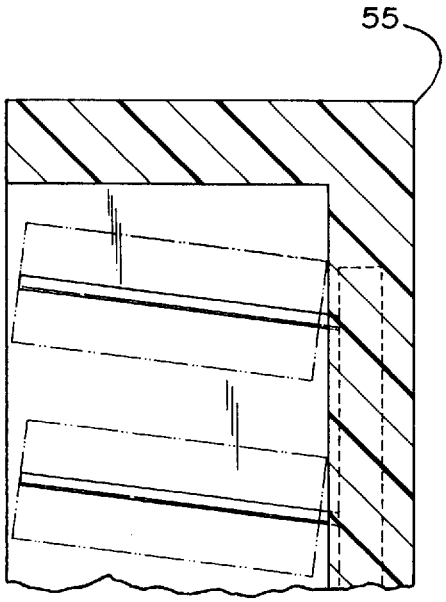
FIG. 13 is a side cross-sectional view of the curling roll receiving dowels of the alternate embodiment of the present invention.
Figure 14:
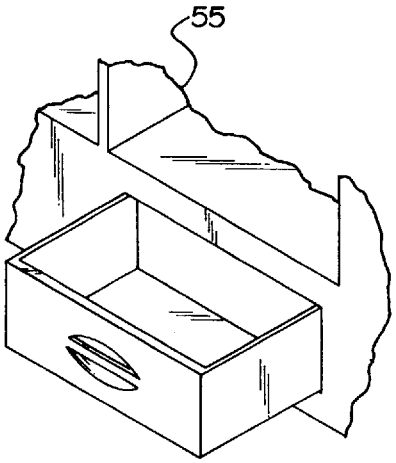
FIG. 14 is a perspective view of the drawer of the alternate embodiment of the present invention.

A second one of the side portions 33 is equipped with a small drawer 34 having a first face with a handle for sliding the drawer away from the second side portion. Similar to the drawer of the first side portion, an open face of the present drawer is provided for gaining access thereto when slid away from the second side portion. A removable tray 36 is situated within the drawer of the second side portion. As shown in FIG. 7, such removable tray is equipped with multiple packets 38. The drawers of the present invention are specifically tailored to store items such as combs, brushes, hair care utensils and the like. It should be noted that the second side portion further includes a large pouch 40, as shown in FIG. 9, and a plurality resilient C-shaped clamps.

Also included is a power cord dispensing assembly 42 situated within the base. The power cord includes a cord having a first end with a plug which is dispensable from a cut out formed in one of the short end faces of the base.

FIGS. 2–4 show an accessory mount 44 having a rectangular configuration and being integrally coupled to the top face of the base of the housing. The accessory mount includes a top face with a first recess 45 having a plurality of heated dowels situated therein and connected to the power cord. As such, the heated dowels are adapted for receiving and heating curlers releasably situated thereon. The top face of the accessory mount is further equipped with a second recess 46 with a circular portion and an elongated portion for accepting a hair dryer. Lastly, the top face has a third and fourth recess 47 flanking the first recess for accepting various clippers.

It should be noted that each of the clippers and any other electric hair care accessory of the present invention may be releasably connected to an auxiliary cord which is connected to the power cord assembly. Such auxiliary cords each have a dedicated spring-biased dispensing assembly for allowing the convenient use of the hair care accessory. As an option, each of the hare care accessories may be colored a color similar to that which the housing is colored for identification purposes.

The accessory mount further includes a rectangular cut out 48 formed along a height thereof for defining a bottom wall and a pair of perpendicular walls. An outer wall preferably encompasses at least ½ the rectangular cut out. One of such perpendicular walls has a plurality of resilient C-shaped scissors and curling iron clamps 50. Further, the bottom wall has a plurality of circular recesses 52 each formed therein below an associated one of the clamps.

During use, the side portions are adapted to be pivoted together such that the lips thereof encompass the accessory mount. For selectively preventing unauthorized access to the accessory mount and the interior spaces of the side portions of the housing, a locking assembly 53 is preferably included. A timer 55 is positioned on the housing for indicating a cessation of a selected time period. Further options include a pouch situated in one of the side portions for housing a spray bottle. Also, universal power outlets may be mounted on the housing and connected to the power cord assembly.

In an alternate embodiment 55, as shown in FIGS. 10–14, the accessory mount may be excluded for a more simplistic design. Such design is ideally tailored for being mounted on a recipient surface(i.e. desk, shelf, counter, wall etc.) Further, in the present embodiment, a mirror 56 and associated light assembly may also be situated on the housing. The dowels and drawer of the alternate embodiment are preferably configured in a manner shown in FIGS. 13 & 14. It should be noted, however, that the various relative orientations of the accessories of the present invention may be rearranged per the desires of the user. Further, the size of the present invention may vary for accommodating different applications.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair care product carrying case comprising, in combination:

a housing including a base with a rectangular configuration comprising a bottom face, a top face and a periphery formed therebetween defined by a pair of elongated side faces and a pair of short end faces, the housing further including a pair of side portions each including a rectangular face and a rectangular side wall integrally coupled to a periphery of the rectangular face and extending outwardly therefrom for defining an interior space with an open face having a peripheral edge defined by a pair of elongated side edges and a pair of short ends edges, wherein one of the elongated side edges of the peripheral edge of the side portions is hingably coupled to opposite sides of the top face, the side wall of at least one of the side portions further including a planar lip extending upwardly from one of the side edges and one of the end edges thereof in coplanar relationship therewith;

wherein a first one of the side portions of the housing has a compartment with a mounting plate having a laterally extending retaining strap, a pair of elongated slots formed in side faces thereof adjacent to one end face thereof, and a pair of support arms each including a first end pivotally coupled to the first side portion and a second end slidably and rotatably mounted within an associated one of the elongated slots wherein the mounting plate may be selectively angled upwardly, the first one of the side portions further including a large drawer having a first face with a handle for sliding the drawer away from the first side portion, an open face for gaining access to the drawer when slid away from the first side portion, and a removable tray situated within an interior space of the drawer with multiple compartments formed therein, the first side portion further including a plurality resilient C-shaped clamps;

wherein a second one of the side portions is equipped with a small drawer having a first face with a handle for sliding the drawer away from the second side portion, an open face for gaining access to the drawer when slid away from the second side portion, and a removable tray with multiple packets situated therein, the second side portion further including a large pouch and a plurality resilient C-shaped clamps;

a power cord dispensing assembly situated within the base and including a cord having a first end with a plug which is dispensable from a cut out formed in one of the short end faces of the base;

an accessory mount having a rectangular configuration and being integrally coupled to the top face of the base of the housing, the accessory mount including a top face with a first recess having a plurality of heated dowels situated therein and connected to the cord for receiving and heating curlers releasably situated thereon, a second recess with a circular portion and an elongated portion for accepting a hair dryer, and a third and fourth recess flanking the first recess for accepting various clippers, the accessory mount including a rectangular cut out formed along a height thereof for defining a bottom wall and a pair of perpendicular walls one of which has a plurality of resilient C-shaped scissors and curling iron clamps, wherein the bottom wall has a plurality of circular recesses each formed therein below an associated one of the clamps, wherein the side portions are adapted to be pivoted together such that the lips thereof encompass the accessory mount;

a locking assembly for selectively preventing unauthorized access to the accessory mount and the interior spaces of the side portions of the housing; and a timer mounted on the housing for indicating a cessation of a selected time period.

2. A hair care product carrying case comprising:

a housing including a base and a pair of side portions each hingably coupled to opposite sides of the base;

one of said side portions including a mounting plate having a laterally extending retaining strap, an elongated slot formed in a side face thereof adjacent to an end face thereof, and a support arm including a first end pivotally coupled to a bottom face of the side portion and a second end slidably and rotatably mounted within the elongated slot wherein the mounting plate may be selectively angled upwardly and further stored within the side portion against the bottom face thereof; and a plurality of hair care accessories releasably mounted within the housing.

3. A hair care product carrying case as set forth in claim 2 wherein a timer is mounted on the housing for indicating a cessation of a selected time period.

4. A hair care product carrying case as set forth in claim 2 wherein an accessory mount is situated on the base and is adapted to be encompassed by the side portions, wherein the accessory mount includes a plurality of hair care accessories mounted thereon.

5. A hair care product carrying case as set forth in claim 4 wherein the accessory mount includes a top face with a recess having a plurality of heated dowels situated therein.

6. A hair care product carrying case as set forth in claim 4 wherein the accessory mount includes a recess with a circular portion and an elongated portion for accepting a hair dryer.

7. A hair care product carrying case as set forth in claim 4 wherein the accessory mount includes a plurality of resilient C-shaped scissors and curling iron clamps.

8. A hair care product carrying case as set forth in claim 2 wherein a power cord dispensing assembly is situated within the housing and includes a cord having a first end with a plug which is dispensable.

9. A hair care product carrying case as set forth in claim 2 and further including a locking assembly for selectively preventing unauthorized access to interior spaces of the side portions of the housing.

* * * * *